US006199786B1

(12) United States Patent
Lessard et al.

(10) Patent No.: US 6,199,786 B1
(45) Date of Patent: Mar. 13, 2001

(54) WIRE REEL ASSEMBLY AND WIRE REEL THEREFOR

(75) Inventors: Claude Lessard, Lévis; Rock Nolet, St-Joseph de Beauce, both of (CA)

(73) Assignee: IPL, Inc., St-Damien-de-Bellechasse (CA)

( * ) Notice: Subject to any disclaimer, the term of this patent is extended or adjusted under 35 U.S.C. 154(b) by 0 days.

(21) Appl. No.: 09/256,335

(22) Filed: Feb. 19, 1999

(51) Int. Cl.[7] ..... B65H 75/38

(52) U.S. Cl. ..... 242/406; 242/396.9; 242/407.1; 242/563.2; 242/423.2; 242/597.4; 242/608.5; 242/609.1

(58) Field of Search ..... 242/406, 403.1, 242/407.1, 597.4, 608.5, 609.1, 391, 563, 563.2, 396.1, 396.9, 423.1, 423.2

(56) References Cited

U.S. PATENT DOCUMENTS

| | | | | |
|---|---|---|---|---|
| D. 286,493 | | 11/1986 | Floyd | D8/358 |
| D. 330,471 | | 10/1992 | Rogers | D6/464 |
| 3,410,500 | * | 11/1968 | Elliott | 242/609.1 |
| 3,536,275 | * | 10/1970 | Salomon | 242/406 |
| 3,796,392 | | 3/1974 | Starace | 242/156 |
| 3,820,733 | | 6/1974 | Roederer . | |
| 3,951,354 | * | 4/1976 | Bagby . | |
| 4,034,933 | | 7/1977 | Hara et al. | 242/129.8 |
| 4,114,826 | * | 9/1978 | Diebolder | 242/406 |
| 4,124,176 | | 11/1978 | Carlson et al. | 242/156 |
| 4,190,211 | | 2/1980 | Janzen . | |
| 4,226,383 | | 10/1980 | Douglas . | |
| 4,325,522 | | 4/1982 | Sauber . | |
| 4,368,858 | * | 1/1983 | Salomon | 242/406 X |
| 4,469,289 | | 9/1984 | Gebo . | |
| 4,508,285 | | 4/1985 | McMillan . | |
| 4,607,806 | | 8/1986 | Yealy | 242/117 |
| 4,625,931 | * | 12/1986 | Tamura et al. | 242/423.1 |
| 4,700,908 | | 10/1987 | Easter . | |
| 4,706,906 | * | 11/1987 | Roman et al. | 242/403.1 X |
| 4,746,078 | | 5/1988 | Setzke . | |
| 4,756,486 | * | 7/1988 | Campbell | 242/396.9 |
| 4,789,414 | | 12/1988 | Ritter et al. | 156/184 |
| 4,878,631 | * | 11/1989 | Tanovici . | |
| 4,903,911 | * | 2/1990 | Sepke | 242/391 X |
| 4,946,113 | | 8/1990 | Riffle et al. . | |
| 5,060,882 | | 10/1991 | Rousculp et al. . | |
| 5,186,410 | | 2/1993 | Toews . | |
| 5,482,221 | | 1/1996 | Peterson et al. | 242/285 |
| 5,522,584 | | 6/1996 | Kononov et al. | 254/134.3 R |
| 5,575,437 | * | 11/1996 | Campbell | 242/609.1 X |
| 5,622,333 | | 4/1997 | Jacques | 242/578.2 |
| 5,692,701 | | 12/1997 | Holliday | 242/598.5 |
| 5,718,397 | | 2/1998 | Stevens | 242/608.8 |
| 5,725,175 | * | 3/1998 | Thundatil | 242/423.2 |
| 5,732,899 | | 3/1998 | Wells | 242/423.1 |
| 5,743,486 | * | 4/1998 | Bulman | 242/609.1 X |
| 5,775,621 | | 7/1998 | Sauber | 242/391.1 |
| 5,806,788 | * | 9/1998 | Witwer et al. | 242/609.1 X |

* cited by examiner

*Primary Examiner*—William A. Rivera
(74) *Attorney, Agent, or Firm*—Quarles & Brady LLP

(57) ABSTRACT

A wire reel assembly comprises a reel, a reel support and a reel securing assembly. The reel includes a central body and removable sides. The central body is removably mounted to an arm of the reel support thereby allowing one of the removable sides to be disconnected from the central body without requiring disassembly of the reel support. The reel securing assembly is also used as an adjustable brake assembly since it includes a friction element contacting the body of the reel to generate a friction force.

24 Claims, 8 Drawing Sheets

WIRE REEL ASSEMBLY AND WIRE REEL THEREFOR

FIELD OF THE INVENTION

The present invention relates to reels. More specifically, the present invention is concerned with a wire reel that approximately indicates the amount of wire remaining on the reel. According to another aspect of the present invention, a wire reel assembly allowing easy replacement of the type of wire mounted to the reel is described.

BACKGROUND OF THE INVENTION

Wire reels assemblies are well known in the art. They usually consist of a reel mounted to a reel support allowing free rotation of the reel.

Two general types of wire reels assemblies exist. The first type of wire reel assemblies is mainly concerned with reels that are not reusable, for example, reels made of cardboard and plywood onto which wire is coiled by the wire manufacturer and that are designed to be discarded when they are empty.

The second type of wire reel assemblies are concerned with reusable reels onto which coils of wire may be mounted and removed. This type of wire reel assemblies are becoming increasingly popular since their use allow the wire manufacturers to supply their coils of wire unmounted to reels, thus reducing production costs. Furthermore, reusable reels are inherently environment friendly.

Known wire reel assemblies of the second type suffer from many drawbacks. For example, they require the reels to be removed from the support to allow the removal of the coil of wire from the reel; they do not provide ways to bind the coil of wire before it is removed from the reel; they do not provide a visual indication of the amount of wire remaining on the reel.

OBJECTS OF THE INVENTION

An object of the present invention is therefore to provide an improved wire reel assembly.

SUMMARY OF THE INVENTION

More specifically, in accordance with the present invention, there is provided a wire reel assembly comprising:

- a reel having a central aperture;
- a reel support including:
  - a base provided with first and second ground engaging portions interconnected by a generally inverted Y-shaped assembly having a proximate end and first and second distal ends; the first and second distal ends being mounted respectively to the first and second ground engaging portions;
  - an arm so mounted to the proximate end of the inverted Y-shaped assembly as to have a free distal end; the arm being configured and sized to rotatably receive the reel; and
- a reel securing assembly removably interconnecting the reel and the reel support.

According to a second aspect of the present invention, there is provided an adjustable brake mechanism for a wire reel assembly including a reel having a central aperture and a reel support provided with an arm configured and sized to rotatably receive the reel; the the arm having a proximate end provided with a fixed abutment element having a friction surface, and a distal end; the adjustable brake mechanism comprising a pressure applying element configured and sized to be removably mounted to the distal end of the the arm to bias the reel towards the fixed abutment element to thereby generate a friction force between the friction surface and the reel; the pressure applying element being longitudinally movable with respect to the the arm to modify the friction force.

According to yet another aspect of the present invention, there is provided a wire reel comprising:

- a generally cylindrical body having first and second opposite ends;
- first and second generally circular sides; the first and second sides being configured and sized to be removably mounted to respective first and second opposite ends of the body; the first and second sides including radially provided marks indicating the amount of wire remaining onto the reel.

It is to be noted that the term "wire" used in the present disclosure and in the appended claims is to be construed as any type of wires that may be wound onto a reel such as, for example, electrical wires, electrical cables, fiber optic cables, telephone cables, cables, ropes and the like.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
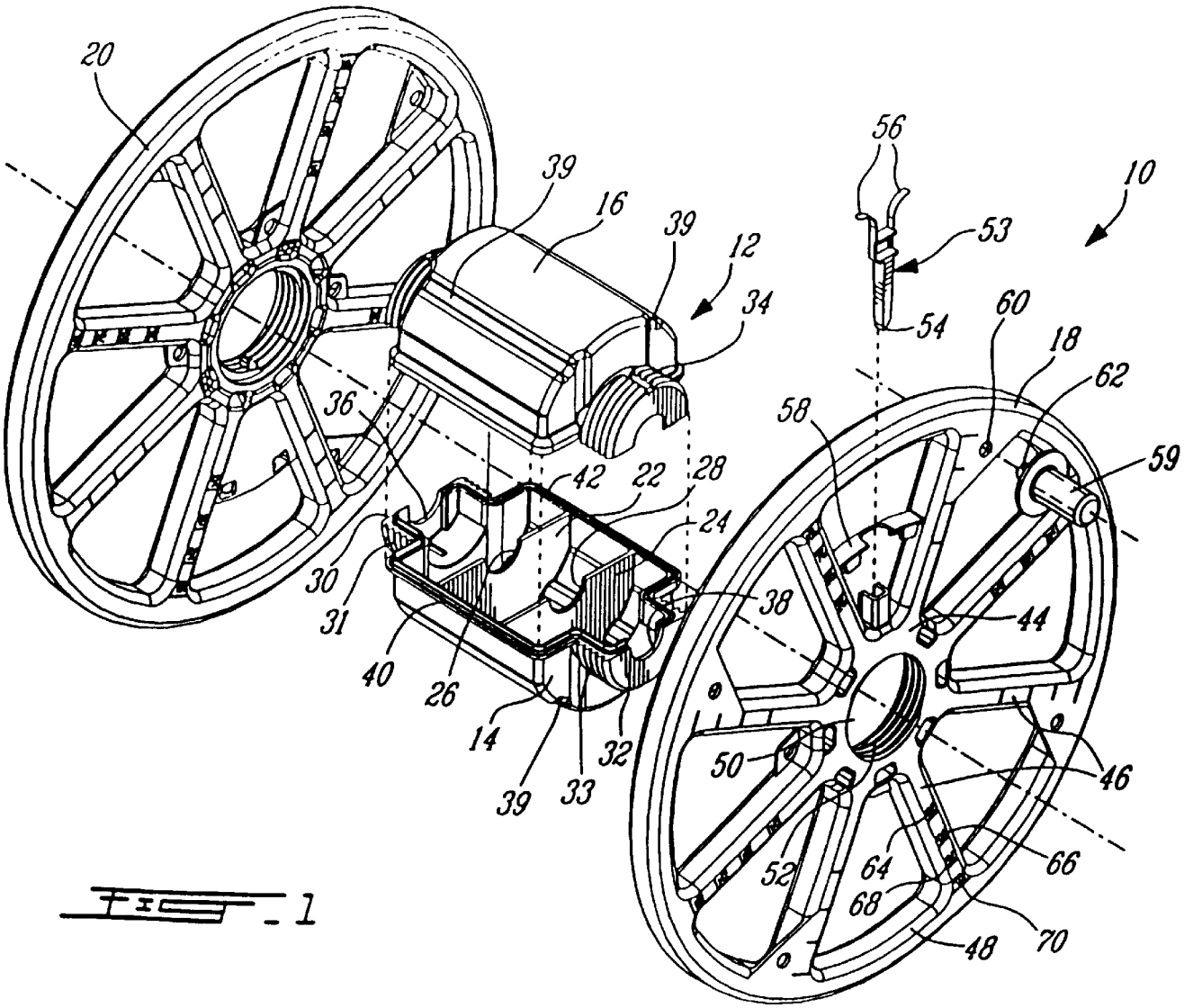
FIG. 1 is an exploded perspective view of a reel according to an embodiment of the present invention.

Turning now to FIG. 1 of the appended drawings, a reel 10 according to an aspect of the present invention will be described.

The reel 10 includes a central body 12 formed by two identical semi-cylindrical half shells 14 and 16, and two identical generally circular sides 18 and 20. For concision purposes, only half-shell 14 and side 18 will be described in greater details hereinbelow.

The various elements of the reel 10 are advantageously made of plastic material such as, for example, high density polyethylene (HDPE), by means of injection molding. Of course, other materials and/or manufacturing techniques, such as blow molding or rotational molding could also be used.

The half-shell 14 is generally hollow and includes two reinforcing walls 22 and 24 provided with respective semi-circular cutouts 26 and 28. Each longitudinal end of the half-shell 14 has a semi-cylindrical projection 30, 32 provided with external threads 31, 33. As can be better seen from half-shell 16, these external threads include longitudinal channels 34. Semi-circular apertures 36, 38 are also provided in the projections 30 and 32. Of course, more than two reinforcing walls, such as walls 22 and 24 could be provided.

As will be easily understood by one skilled in the art, the semi-circular cutout portions 26, 28, 36 and 38 are aligned and form, with the complementary cutout portions (not shown) of the half-shell 16, a circular aperture going through the body 12 when the half-shells are interconnected. Similarly, the external threads 31 and 33 of the half shells 14 and 16 are complementary and form, then the half-shells 14 and 16 are interconnected, a conventional helical thread.

As can be better seen from half-shell 16, longitudinal channels 39 are provided on the external surface thereof. The purpose of these longitudinal channels will be described hereinbelow.

The half-shell 14 also includes a peripheral projection 40 and a complementary channel 42. These complementary elements interconnect the two half-shells 14 and 16. Of course, adhesives or other fastening means (not shown) may be used to secure the two half-shells 14 and 16. Furthermore, the half-shells 14 and 16 could be welded using an electromagnetic welding process or the projection 40 and channel 42 could be designed to be press fitted or snapped.

When the half-shells 14 and 16 are interconnected to form the body 12, they may receive the sides 18 and 20.

The side 18 has a hub 44, eight spokes 46 integrally formed with the hub 44 and a peripheral portion 48 integrally formed with the spokes 46.

The hub 44 includes a central aperture 50 provided with internal threads 52 complementary to the external threads 31, 33 of the body 12. The aperture 50 allows the side 18 to be screwed to the body 12. The hub 44 also includes a radial aperture (not shown) configured and sized to receive a Y-shaped rotation preventing element 53.

The Y-shaped rotation preventing element 53 includes a distal end 54 configured and sized to enter the radial aperture of the hub 44 and contact the threaded external portions of the body 12. The element 53 also includes two proximate ends 56 contacting a mounting element 58 provided between two adjacent spokes 46 to act as a spring that radially biases the distal end 54 towards the center of the side 18. Therefore, when the distal end 54 faces a longitudinal channel 34 of the body 12, the biasing action of the proximate ends 56 will force the distal end 54 therein, thereby preventing further rotation of the side 18 with respect to the body 12. Of course, the user may manually overcome the biasing force to allow rotation of the side 18.

The rotation preventing element 53 is advantageously provided to prevent unwanted separation of the side 18 from the body 12 during the operation of the reel 10.

The peripheral portion 48 is provided with a handle 58 that may be mounted to an aperture 60 via a spring lock 62 allowing the handle 59 to be easily disconnected from the reel 10.

Every other spoke 46 is provided with radial marks 64, 66, 68 and 70 respectively indicating that the approximate amount of wire remaining on the reel 10 is 25%, 50%, 75% and 100% of the capacity of the reel 10. It is to be noted that these marks are also provided onto the internal surfaces of the spokes (see for example the spokes of the side 20). This feature of the reel 10 is advantageous since it allows, for example, the user to more precisely determine the amount of wire used when a particular task is over. Similarly, the user may verify the approximate amount of wire remaining onto the reel 10 before beginning a particular task to determine if the reel 10 has enough wire thereon.

Figure 2:
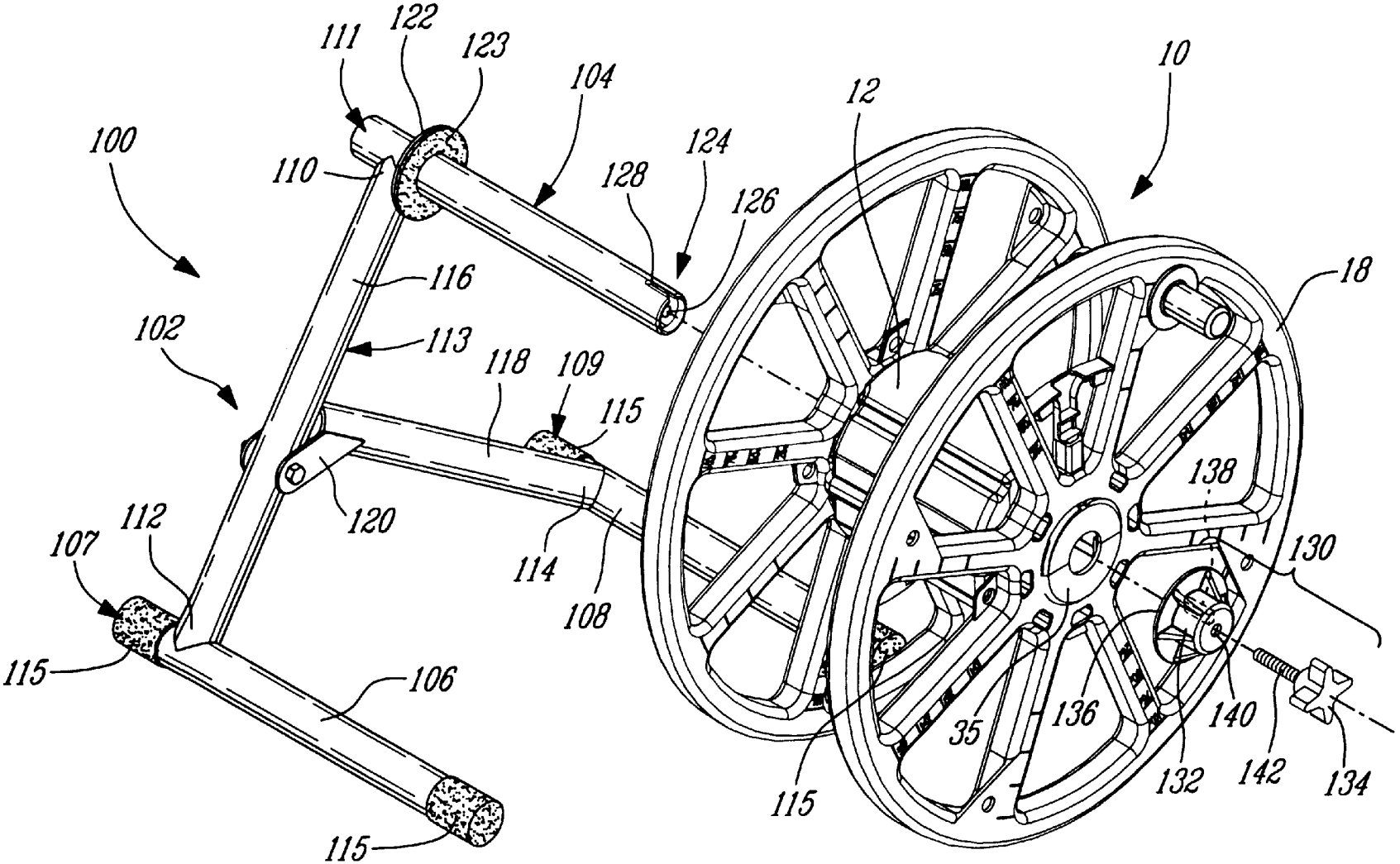
FIG. 2 is a perspective view of the reel of FIG. 1 before its installation to a reel support according to a first embodiment of the present invention.

Turning now to FIG. 2 of the appended drawings, a reel support 100 according to another aspect of the invention will be described. The reel support 100 includes a base 102 and a cantilever arm 104.

The base 102 is provided with first and second generally parallel ground engaging portions 106, 108 interconnected by a generally inverted Y-shaped assembly 113 having a proximate end 110 and first and second distal ends 112, 114; the first and second distal ends 112, 114 being mounted respectively to the first and second ground engaging portions 106, 108. Of course, the ground engaging portions 106 and 108 could be other than straight. For example, they could be arcuate with ends provided in a common plane.

Both ends of each ground engaging portions 106 and 108 are optionally provided with anti-skid elements 115.

The generally inverted Y-shaped assembly 113 is formed by a first tube 116 defining the proximate end 110 and the first distal end 112 and by a second tube 118, shorter than the first tube 116 and pivotally connected thereto via a pivotal connection 120. The second tube 118 defining the second distal end 114. The pivotal connection 120 between the first and second tubes 116 and 118 allow the support 100 to be pivoted between a supporting position shown in FIGS. 2 to 4 and a transport position shown in FIG. 5.

The cantilever arm 104 is generally cylindrical and is so mounted to the proximate end 110 of the inverted Y-shaped assembly 113 as to be generally parallel to the first and second ground engaging portions 106 and 108. Of course, the arm 104 is sized to rotatably receive the reel 10 via its longitudinal aperture.

The arm 104 includes a circular abutting element 122 fixedly mounted to a proximate end thereof and a circular friction element 123 removably mounted to the abutting element 122. The circular friction element 123 therefore defining a friction surface of the abutting element 122. Both the abutting element 122 and the friction element 123 are slightly smaller than the circular surface (formed by the semi-cylindrical projections 30, 32) of the body 10. Of course, the circular shape of the element 122 is not critical and abutting element having other shapes could be used.

The free distal end 124 of the arm 104 is provided with an internally threaded opening 126 and with a longitudinal slot 128, the purpose of which will be described hereinafter.

The various elements forming the reel support assembly 100 are advantageously secured to one another by welding. Alternatively, these elements could be interconnected by fasteners (not shown) or could even be made of folded tubular material.

A reel securing assembly 130 is also provided to removably secure the reel 10 to the reel support 100. The reel securing assembly 130 also constitutes an adjustable brake assembly as will be readily apparent by the following description.

The reel securing assembly includes a pressure applying element 132 and a fastener 134.

The pressure applying element 132 includes a pressure applying surface 136 slightly smaller than the circular surface 35 (formed by the semi-cylindrical projections 30, 32) of the body 10. Therefore, the presence of the pressure applying element 132 will not prevent the user from removing the side 18 from the body 12.

The pressure applying element 132 includes an aperture (not shown) allowing its installation onto the free distal end 124 of the arm 104. A longitudinal rotation preventing projection 138 projects into this aperture of the pressure applying element 132 and into the slot 128 of the arm 104. As will be easily understood by the following description, the pressure applying element 132 is advantageously prevented from rotating with the rotation of the reel 10.

A central aperture 140 of the element 132 allows a threaded portion 142 of the fastener 134 to pass through and to be screwed in the aperture 126 of the arm 104.

As will be easily understood by one skilled in the art, clockwise rotation of the fastener 134 will increase the biasing force applied by the pressure applying surface 136 to the circular surface 35, thereby increasing the friction force between the friction element 123 of the support 100 and the body 12, that, in turn, increases the reel braking action of the adjustable brake assembly 130. Indeed, rotation of the fastener 134 causes the longitudinal movement of the pressure applying element 132 with respect to the arm 104.

The pressure applying element 132 is advantageously made of HDPE to prevent premature wear of both the pressure applying element 132 and of the reel body 12. Of course, the element 132 could be made of other materials that are advantageously less resistant to wear than HDPE so as to prevent premature wear of the body 12. Similarly, the friction element 123 of the support 100 is advantageously made of a material that is less resistant to wear than the HDPE material forming the body 12 so as to prevent premature wear of the body 12. Indeed, it is found advantageous to replace the pressure applying element 132 and/or the friction element 123 instead of replacing the entire body 12.

As will easily be understood by one skilled in the art, the reel securing assembly 130 could be made of only one element (not shown). However, it would be more complicated to prevent such an element from rotating.

It is to be noted that the brake assembly 130 is advantageous since it prevents wire overrun that may lead to wire entanglement and waste of wire. Furthermore, since the brake assembly is adjustable, each user may modify the tension required to unwind the wire according to personal work habits.

Figure 3:
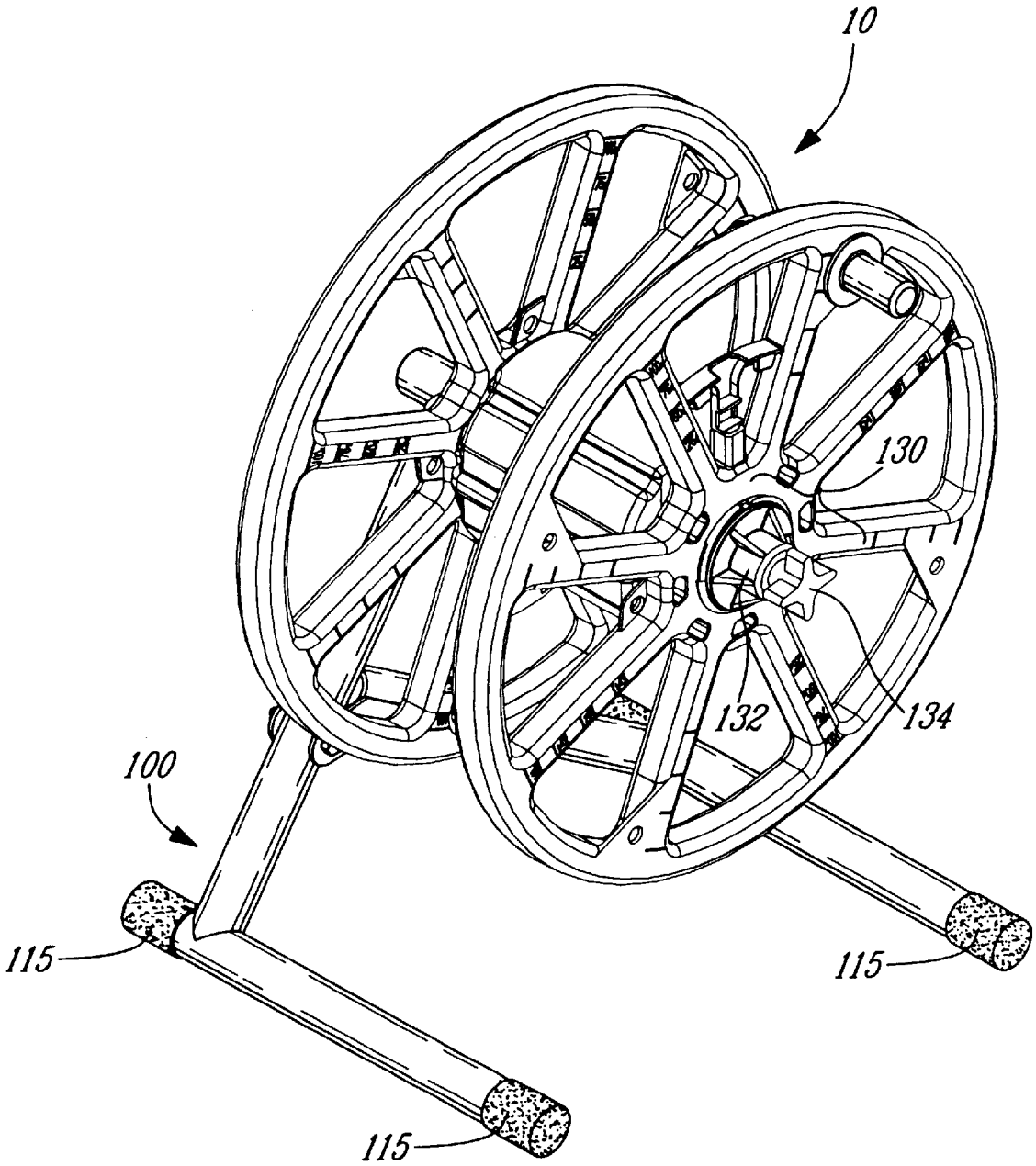
FIG. 3 is a perspective view of the reel of FIG. 1 mounted to the reel support of FIG. 2.

FIG. 3 of the appended drawings illustrates the reel 10 mounted to the support 100 and secured thereto via the reel securing assembly 130.

Figure 4:
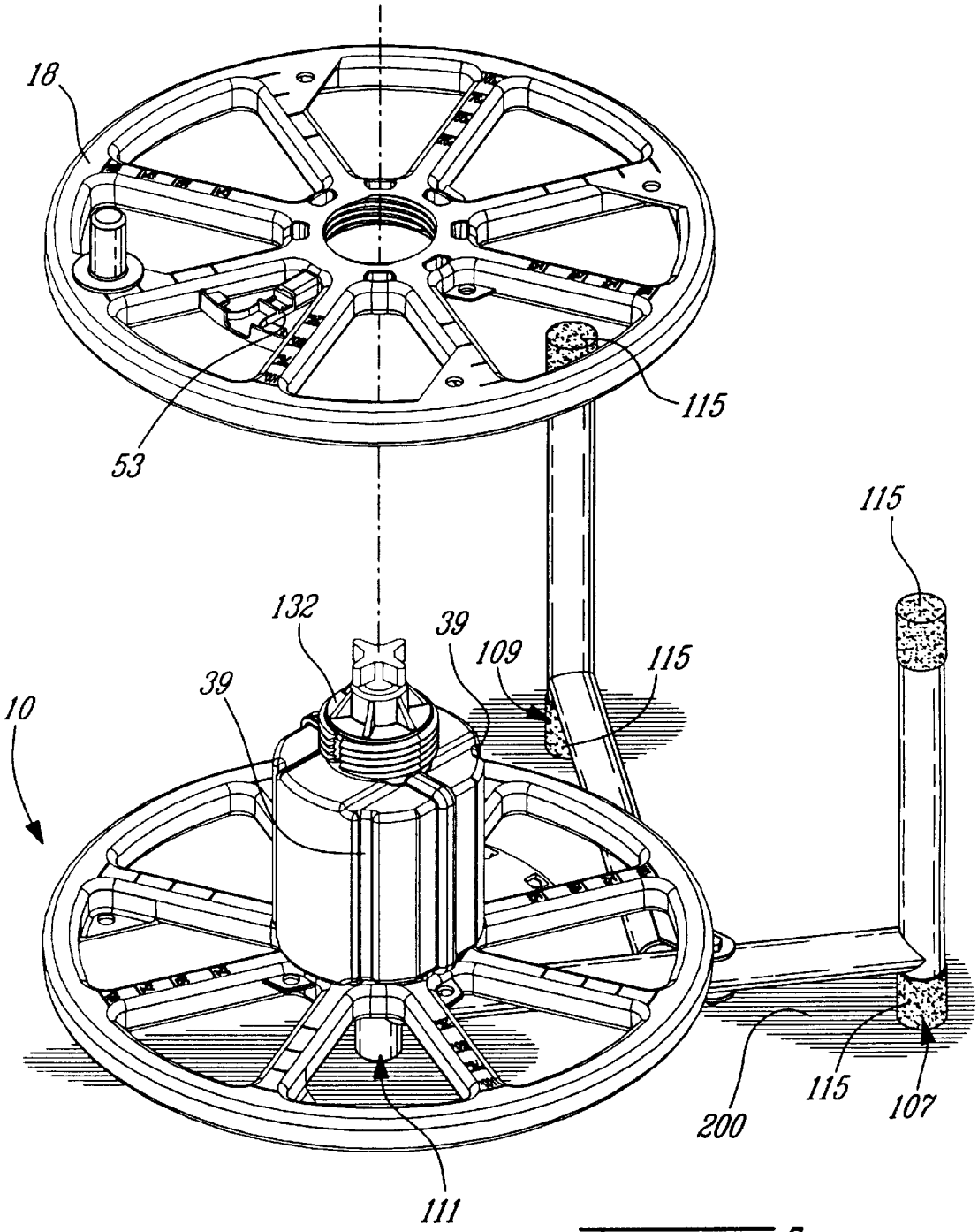
FIG. 4 is a perspective view of the reel of FIG. 1 mounted to the reel support of FIG. 2, one side of the reel being removed from the reel to allow a coil of wire to be added/removed from the reel.

Turning now to FIG. 4 of the appended drawings, the removal of a partially used coil of wire (not shown) from the reel 10 or the insertion of a coil of wire onto the reel 10 will be described.

The first step is to place the support 100 so that the ends 107, 109 and 111 are on the ground 200. Then, the user may remove the side 18 by a counterclockwise rotation of the side 18 while manually overcoming the biasing force of the rotation preventing element 53 and preventing the rotation of the body 12.

The result of the steps described hereinabove is illustrated in FIG. 4. When the reel 10 is as indicated in this figure, to safely remove the coil of wire from the reel, the user merely has to use a securing element such as twine, string, Ty Rap® fasteners, or the like, to temporarily bind the remaining wire together via at least one of the longitudinal channels 39. This will allow the user to remove the remaining coiled wire from the reel 10 without causing the coil to be sufficiently deformed as to prevent its reinsertion in the reel 10.

It is to be noted that the pressure applying element 132 does not prevent the side 18 to be removed from the reel 10. Similarly, since the arm 104 is a cantilever arm, no disassembly of the support 100 is required to remove the side 18 from the body 12.

Figure 5:
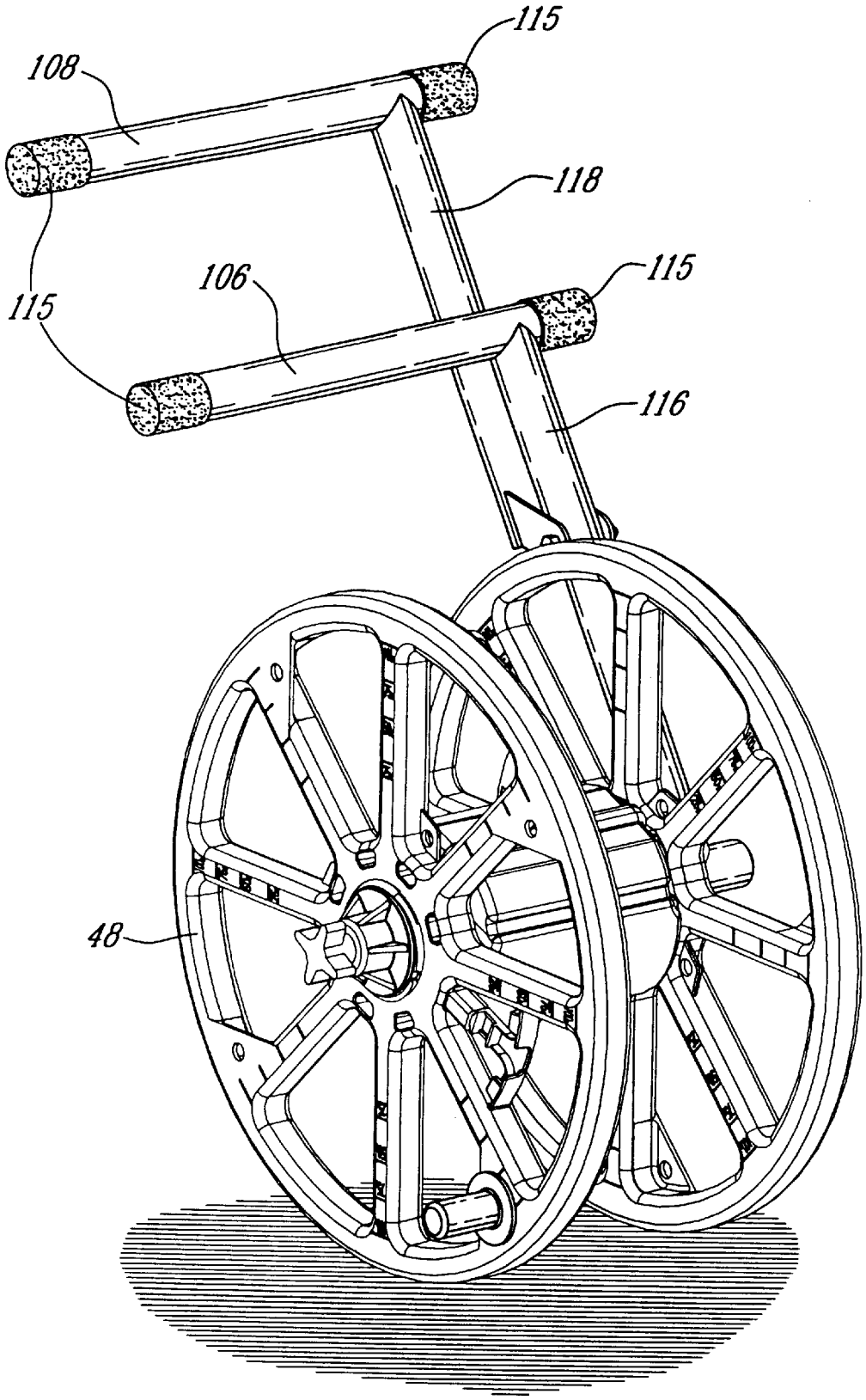
FIG. 5 is a perspective view of the reel support of FIG. 2 in a transport position.

To move the wire reel assembly from one place to another, the reel 10 may be used as a wheel. Indeed, by placing the peripheral portions 48 of both sides 18 and 20 onto the ground, and by pivoting the tube 118 so that it lies parallel to the tube 116, the ground engaging portion 108 may be used as a handle to pull or push the reel 10. This configuration of the support 100 and of the reel 10 is illustrated in FIG. 5.

It is to be noted that the coil of wire may either be installed onto the reel 10 so that it unwinds when the reel rotates clockwise or when the reel rotates counterclockwise. Indeed, the adjustable brake assembly 130 is not affected by the rotation direction.

It is also to be noted that while the support 100 is illustrated as being made of tubular material, advantageously metallic material, the various elements forming the support 100 could also be made of plastic material. Of course, if the support 100 is made of plastic material, various design changes would be required to take into account the characteristics of the material used. Similarly, the support 100 could be made of tubular material having a rectangular or any other suitable cross-section.

If the support 100 is made of metallic tubular material as illustrated in the appended drawings, this metallic material is advantageously a material provided with inherent anti-corrosion properties, such as, for example, galvanized steel, or provided with an anti-corrosion coating. Furthermore, the ends of the various elements are advantageously provided with caps or plugs (not shown) to seal the tubular elements from dirt.

Of course, as will be easily understood by one skilled in the art, by forming the central body 12 with two identical semi-cylindrical half-shells 14 and 16, and by providing identical generally circular sides 18 and 20, it is possible to reduce the manufacturing costs of the reel 10.

Figure 6:
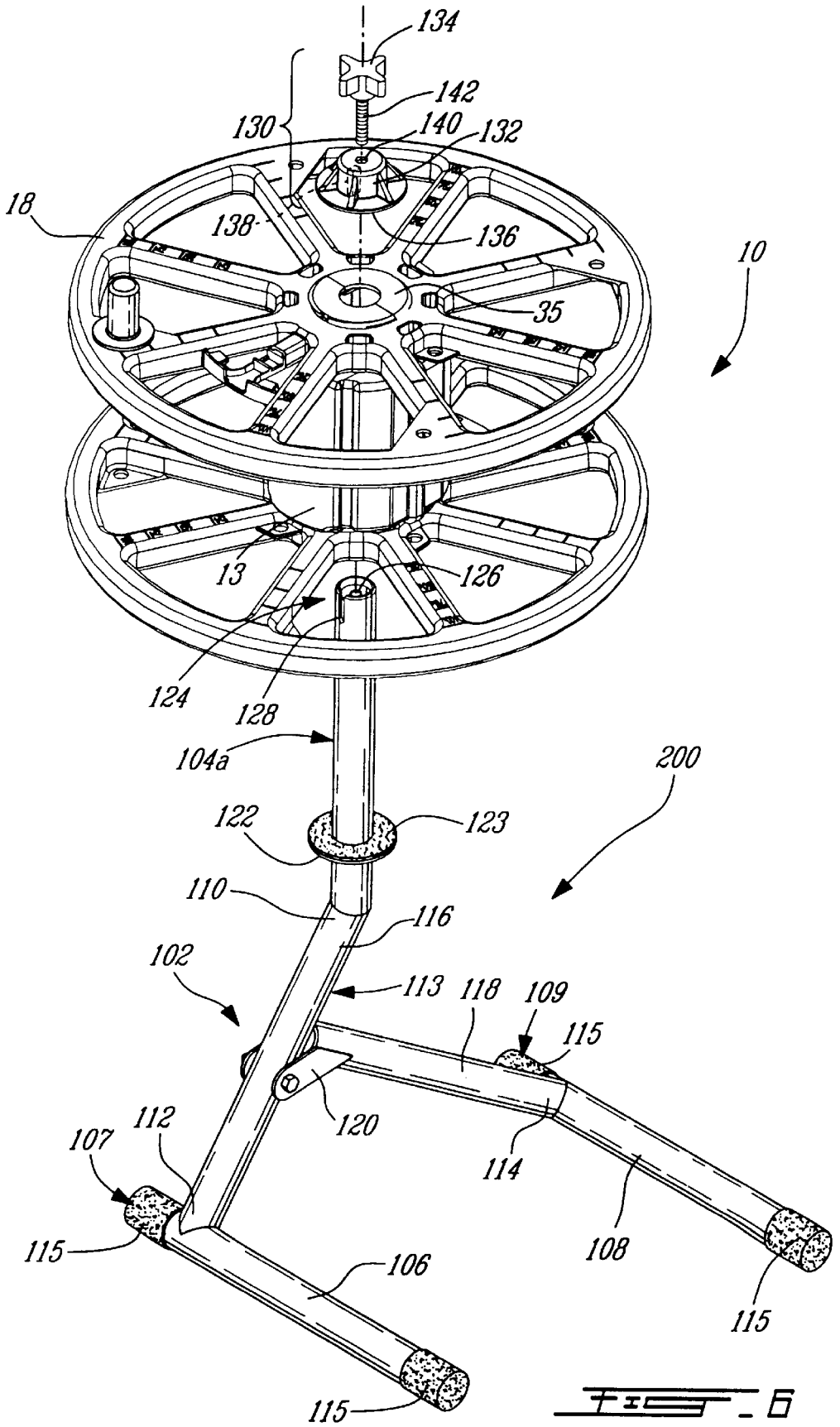
FIG. 6 is a perspective view of the reel of FIG. 1 before its installation to a reel support according to a second embodiment of the present invention.
Figure 7:
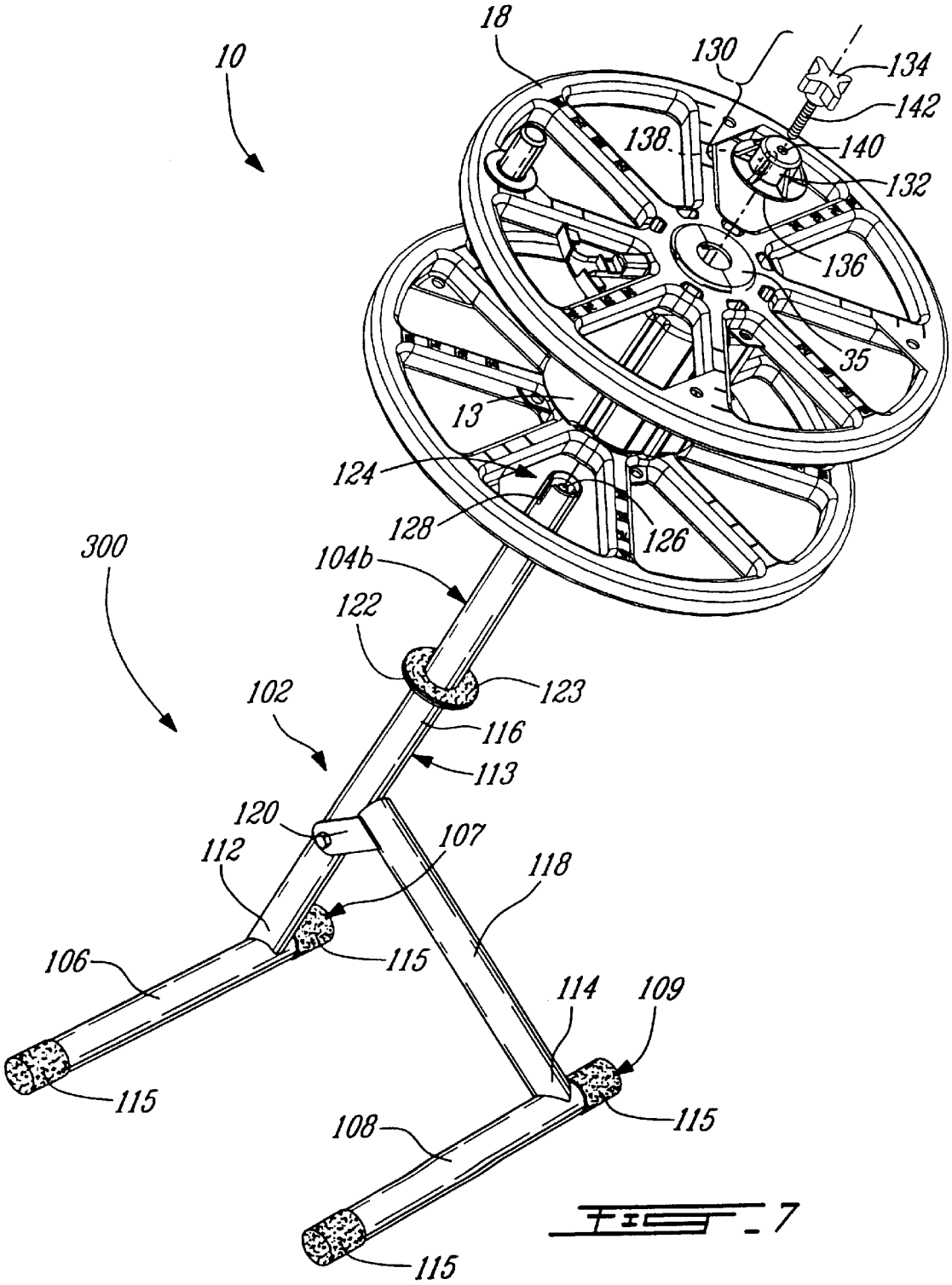
FIG. 7 is a perspective view of the reel of FIG. 1 before its installation to a reel support according to a third embodiment of the present invention.
Figure 8:
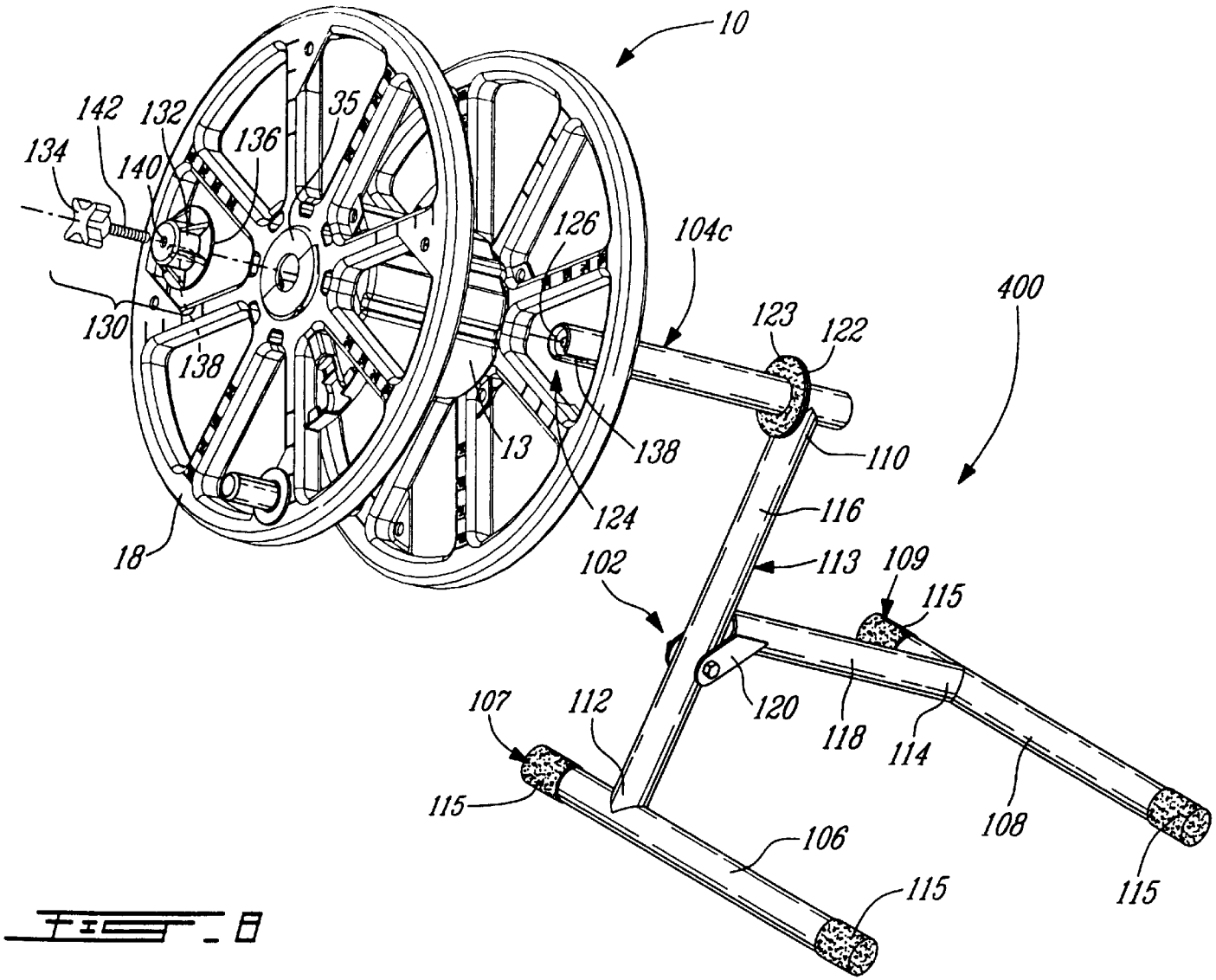
FIG. 8 is a perspective view of the reel of FIG. 1 before its installation to a reel support according to a fourth embodiment of the present invention.

Turning now to FIGS. 6 to 8, other embodiments of the reel support will be described.

More specifically, FIG. 6 illustrates a reel support 200 according to the present invention. Since the reel support 200 is very similar to the reel support 100 described hereinabove, only the differences between these supports will be described hereinafter.

A major difference between the reel 200 and the reel 100 is the position and orientation of the arm 104a which is so mounted to the end 110 of the first tube 116 as to be generally vertical when the ground engaging portions 106 and 108 are supported by a generally horizontal surface. It is to be noted that the end 124 of the arm 104*a* is still a free distal end and that the reel 10 may be mounted and dismounted from the support 200 as described hereinabove with respect to the reel support 100.

It is to be noted that the reel support 200 may be used to transport a reel 100 that is rotatably mounted thereto. However, the transport position of the reel support 200 is not different from its supporting position since, as will be easily understood by one skilled in the art, the support 200 may be pulled or pushed via the ground engaging portion 108 which defines an angle with the rotation axis of the reel 10 when the support 200 is as illustrated in FIG. 6. Of course, to allow the use of the reel 10 as a wheel, the reel 10 must be brought in contact with the ground.

Turning now briefly to FIG. 7, a reel support 300 according to the present invention will be described.

Again, since the reel support 300 is very similar to the reel support 100 described hereinabove, only the differences between these supports will be described hereinafter.

A major difference between the reel 300 and the reel 100 concerns the position and the orientation of the arm 104*b* which is so mounted to the the first tube 116 as to be an extension thereof. The tube 116 and the arm 104*b* may therefore be a single tube to which the circular abutting element 122 is mounted.

It is to be noted that the end 124 of the arm 104*b* is still a free end and that the reel 10 may be mounted and dismounted from the support 300 as described hereinabove with respect to the reel support 100.

It is to be noted that the reel support 300 may be used to transport a reel 100 that is rotatably mounted thereto. However, the transport position of the reel support 300 is not different from its supporting position since, as will be easily understood by one skilled in the art, the support 300 may be pulled or pushed via the tube 108 which defines an angle with the rotation axis of the reel 10 when the support 300 is as illustrated in FIG. 7. Of course, to allow the use of the reel 10 as a wheel, the reel 10 must be brought in contact with the ground.

Finally, FIG. 8 of the appended drawings illustrates a reel support 400 according to the present invention.

Once again, since the reel support 400 is very similar to the reel support 100 described hereinabove, only the differences between these supports will be described hereinafter.

A major difference between the reel 400 and the reel 100 concerns the position and the orientation of the cantilever arm 104*c* which is so mounted to the end 110 of the tube 116 as to be generally perpendicular to the tube 116 while being in the plane defined by the inverted Y-shaped assembly 113.

Another difference between the support 400 and the support 100 is that the first and second distal ends 112 and 114 are respectively centrally mounted to the ground engaging portions 106 and 108. As will be easily understood by one skilled in the art, this position is advantageous since it increases the stability of the support 400 when it is in its supporting position.

It is to be noted that the reel support 400 may be used to transport a reel 100 that is rotatably mounted thereto.

Therefore, as will be easily understood by one skilled in the art, the arm 104 may be positioned in various orientations while allowing the reel support of the present invention to operate as described hereinabove.

Although the present invention has been described hereinabove by way of preferred embodiments thereof, it can be modified, without departing from the spirit and nature of the subject invention as defined in the appended claims.

What is claimed is:

1. A wire reel assembly comprising:

a reel having a central aperture;

a reel support including:

a base provided with first and second ground engaging portions interconnected by a generally inverted Y-shaped assembly having a proximate end and first and second distal ends; said first and second distal ends being mounted respectively to said first and second ground engaging portions;

an arm so mounted to said proximate end of said inverted Y-shaped assembly as to have a free distal end; said arm being configured and sized to rotatably receive said reel; and a reel securing assembly removably interconnecting said reel and said reel support.

2. A wire reel assembly as recited in claim 1, wherein said reel includes:

a generally cylindrical body having first and second opposite ends;

first and second generally circular sides configured and sized to be removably mounted to respective first and second opposite ends of said body.

3. A wire reel assembly as recited in claim 2, wherein said free distal end of said arm is provided with a threaded aperture.

4. A wire reel assembly as recited in claim 3, wherein said reel securing assembly includes a pressure applying element removably mounted to the free distal end of the arm via a fastener cooperating with said threaded aperture.

5. A wire reel assembly as recited in claim 4, wherein said reel support also includes an abutting element provided with a friction surface; said abutting element being so mounted to said arm that said friction surface abuts one of said first and second opposite ends of said generally cylindrical body when said body is rotatably received by said arm.

6. A wire reel assembly as recited in claim 5, wherein said pressure applying element includes a pressure applying surface contacting the other of said first and second opposite ends of said generally cylindrical body.

7. A wire reel assembly as recited in claim 6, wherein said pressure applying element is longitudinally movable with respect to said arm.

8. A wire reel assembly as recited in claim 7, wherein said pressure applying element is so mounted to said free distal end of said arm as to be prevented from rotating.

9. A wire reel assembly as recited in claim 2, wherein each said first and second opposite ends of said body includes a cylindrical projection provided with external threads.

10. A wire reel assembly as recited in claim 9, wherein said first and second circular sides include a central opening provided with internal threads complementary with the external thread of the cylindrical projection of the body thereby allowing the sides to be threaded to said body.

11. A wire reel assembly as recited in claim 10, wherein said external threads include at least one longitudinal channel, and wherein at least one of said first and second sides includes rotation preventing element selectively contacting said at least one longitudinal channel to prevent rotational movements of said one of said first and second sides with respect to said body.

12. A wire reel assembly as recited in claim 2, wherein one of said first and second sides is provided with a handle.

13. A wire reel assembly as recited in claim 2, wherein said body is made of two identical half-shells having an external surface provided with longitudinal channels.

14. A wire reel assembly as recited in claim 2, wherein said first and second sides are identical.

15. A wire reel assembly as recited in claim 1, wherein said arm is so mounted to said Y-shaped assembly as to be generally parallel to said first and second ground engaging portions of said base.

16. A wire reel assembly as recited in claim 1, wherein said arm is so mounted to said Y-shaped assembly as to be generally vertical when said first and second ground engaging portions of said base are supported by a generally horizontal surface.

17. A wire reel assembly as recited in claim 1, wherein a) said Y-shaped assembly is formed of a first longer tube and of a second shorter tube so mounted to said first longer tube as to define said Y-shape, and b) said arm is so mounted to said first longer tube of said Y-shape assembly as to be an extension thereof.

18. A wire reel assembly as recited in claim 1, wherein said arm is so mounted to said Y-shaped assembly as to be in a plane defined by said Y-shaped assembly.

19. A wire reel comprising:

a generally cylindrical body having first and second opposite ends, said body being made of two identical half shells having an external surface provided with longitudinal channels;

first and second generally circular sides; said first and second sides being configured and sized to be removably mounted to respective first and second opposite ends of said body; said first and second sides including radially provided marks indicating the amount of wire remaining onto said reel.

20. A wire reel as recited in claim 19, wherein each said first and second opposite ends of said body includes a cylindrical projection provided with external threads.

21. A wire reel as recited in claim 20, wherein said first and second circular sides include a central opening provided with internal threads complementary with the external thread of the cylindrical projection of the body thereby allowing the sides to be threaded to said body.

22. A wire reel as recited in claim 21, wherein said external threads include at least one longitudinal channel, and wherein one of said first and second sides includes rotation preventing element selectively contacting said at least one longitudinal channel to prevent rotational movements of said one of said first and second sides with respect to said body.

23. A wire reel as recited in claim 19, wherein one of said first and second sides is provided with a handle.

24. A wire reel as recited in claim 19, wherein said first and second sides are identical.

* * * * *